United States Patent [19]

Misener

[11] 4,083,657

[45] Apr. 11, 1978

[54] FLOOD GUARD WARNING SYSTEM, APPARATUS AND PROCESS

[76] Inventor: Doyle R. Misener, Rte. 2, Box 123, Lincoln, Ark. 72744

[21] Appl. No.: 627,247

[22] Filed: Oct. 30, 1975

[51] Int. Cl.[2] ..... F04B 41/06

[52] U.S. Cl. ..... 417/4; 73/304 R; 210/86; 210/104; 417/63

[58] Field of Search ..... 210/86, 104, 152, 170, 210/241; 137/392; 417/3–7, 12, 63; 73/304 R, 313, 328, 329; 415/118

[56] References Cited

U.S. PATENT DOCUMENTS

| | | | |
|---|---|---|---|
| 2,003,760 | 6/1935 | Sweeney et al. | 210/86 X |
| 2,222,595 | 11/1940 | Regester | 417/5 |
| 2,869,368 | 1/1959 | Brown | 73/304 R |
| 2,925,101 | 2/1960 | Dunham | 137/392 X |
| 3,211,167 | 10/1965 | Clift et al. | 210/170 X |
| 3,233,549 | 2/1966 | Howe | 417/40 X |
| 3,262,571 | 7/1966 | Petretti | 210/241 X |
| 3,485,262 | 12/1969 | Perren | 137/392 X |
| 3,630,637 | 12/1971 | Repp | 417/7 |
| 3,730,884 | 5/1973 | Burns et al. | 210/170 X |
| 3,787,733 | 1/1974 | Peters | 137/392 X |
| 3,941,507 | 3/1976 | Niedermeyer | 417/40 X |
| 3,954,612 | 5/1976 | Wilkerson | 210/86 |

*Primary Examiner*—William L. Freeh
*Assistant Examiner*—Edward Look
*Attorney, Agent, or Firm*—Ely Silverman

[57] ABSTRACT

A plurality of horizontally and vertically spaced apart remote liquid level sensor assemblies free of upwardly directed surfaces operatively connect only under emergency conditions to the sump tank of a sewerage system through vertical housings connected to horizontally extending drain lines connected to a sump tank and reliably indicate such emergency conditions for timely corrective action and avoid flood damage.

7 Claims, 12 Drawing Figures

257
46
24
254
204
34
258
25
255
205
44
244
28
35
245
45
256
206
26
190
189
198
59
208
58
229
195
196
199
260
192
228
210
193
37
243
43
47
12A
227
194
209
207
197
261
191
57
39
217
203
23
253
242
42
27
259
32
22
202
252
7B
31
41
21
251
201
241

207
37
63
27
43
243
29
47
33
28
48

51
52
53
54
55
41
42
43
44
45
61
62
63
64
65
211
212
213
214
215
221
222
223
224
225
71
72
73
74
75
81
82
83
84
85
91
92
93
94
95
101
102
103
104
105
109
110
111
112
113
114
115
121
122
123
124
125
131
141
142
143
144
145
151
152
153
154
155
161
162
163
164
165
230
231.1
231.2
231.3
232
233
234
235
271
272
273
274
275
100
120
70

FLOOD GUARD WARNING SYSTEM, APPARATUS AND PROCESS

BACKGROUND OF THE INVENTION

1. The Field of the Invention:

The fields of art to which this invention pertains are sewerage and liquid level responsive and maintaining systems.

2. Description of the Prior Art:

The prior art systems for removing sewerage from drains of dwellings including living areas below the level of municipal sewer lines have been unreliable and expensive in damage to property resulting from failures of such systems to protect property of such locations.

SUMMARY OF THE INVENTION

Liquid level sensors of danger condition in a sump tank are located at several locations each remote from the tank to a location or locations convenient to control. At each of such locations, a signal device is automatically actuated to indicate, independent of sensors in the sump tank, location of potential flood condition and a mobile pumping unit is actuated by communication from site of signal reception. Thereby one separate mobile pump unit services several distantly spaced sites. Such operation results from use of liquid level sensor structure readily placed and located by means of a rigid vertical wall and threaded top and such sensor is readily cleansed of sewage.

Figure 1:
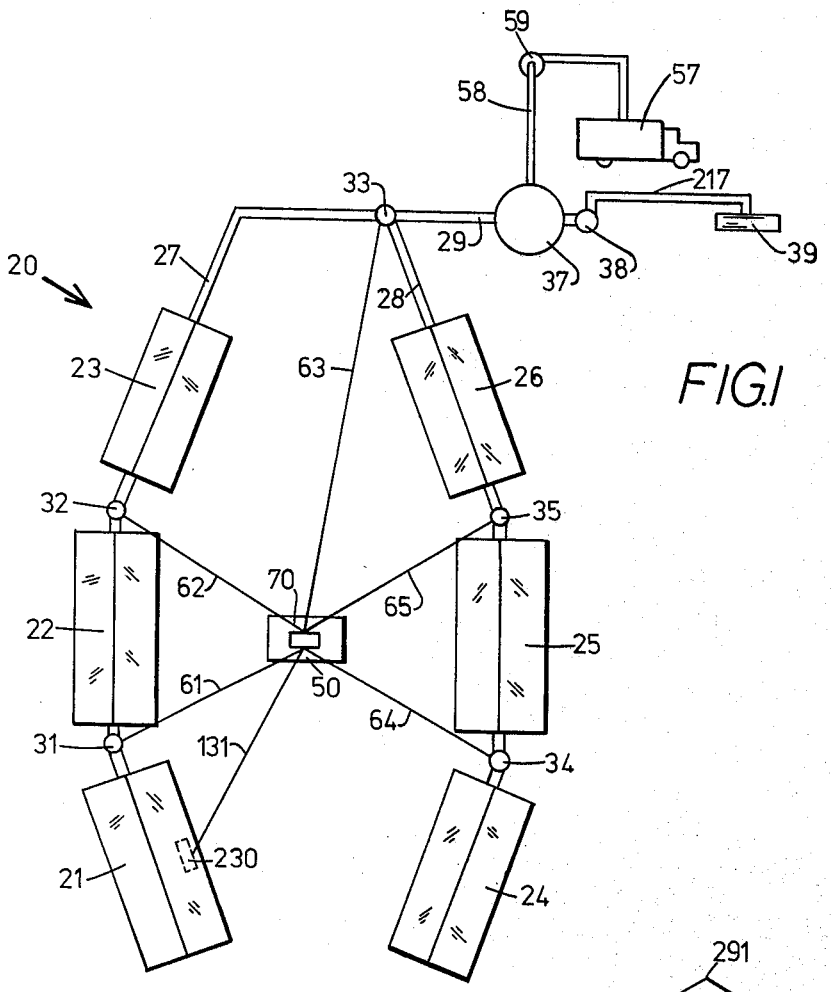
FIG. 1 is an overall plan view of the assembly 20.

DESCRIPTION OF THE PREFERRED EMBODIMENT:

The apparatus of system 20 comprises, in operative combination, (a) a series of apartment houses or residences 21, 22, 23, 24, 25, and 26; each of these houses has a below ground level living area 251–256 respectively; and, for each such house, (b) a drain for liquid waste, 201–206 respectively, and each such drain extends to and connects to:

(c) horizontally extending sloped collecting lines 27 and 28; the lines 27 and 28 are sloped downwardly to (d) a sump tank 37 wherein is located (e) a pump assembly 38 to elevate liquors and liquid suspension in the sump 37 to (f) a sewer drain line 29 located at level above some of the living areas of the apartment houses 21–26, and wherein Each of the collecting lines is operatively connected to (g) a vertical pipe as 241–245 that extends substantially to ground level, and (h) a probe unit 41–45 is located in each of the pipes as 241–245 respectively and is a portion of collecting line liquid level sensor and indicating assemblies as 31–35 respectively.

Each of the sensor and indicating assemblies 31–35 comprises a probe unit 41–45 respectively located in a vertical pipe or tube 241–245 respectively.

Each of electric conductor cables as 61–65 for each of units 31–35 respectively extends from a probe unit as 41–45 (of such units 31–35 respectively) to the central indicator assembly casing 70. Each of the sensor and indicating assemblies as 31 comprises a probe unit 41, (with a test switch 51), a double cable sheathed conductor 61, and a relay coil 71. A normally open relay arm 81 is operatively connected to be closed on energization of its coil as 71 and is connected to a buzzer 91 and pilot light 121, as shown in FIG. 4, when selector switch 101 is placed in its downwardly and leftwardly directed position (FIG. 4 shows the downwardly and rightwardly extended position of switch 101).

Figure 4:
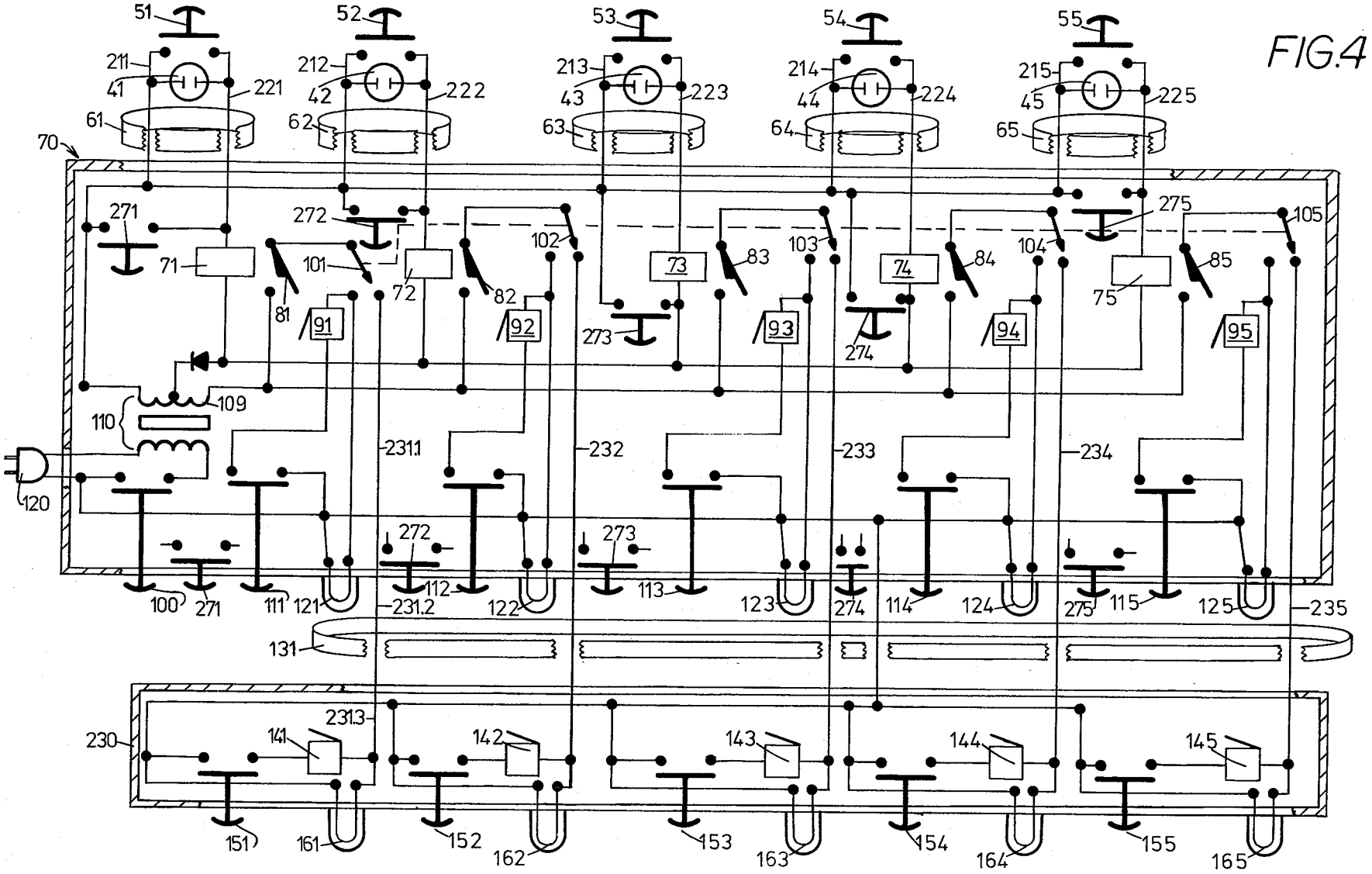
FIG. 4 is an overall wiring diagram of the liquid level sensing and indicating components in the assembly 20.

As shown in FIG. 4 the latch switch 111 is operatively and serially connected to the buzzer 91, and may be put in one position or another depending on operator's control thereof.

A selector switch 101 is operatively connected to the relay arm 81 which (arm 81) is operatively connected to the 12 volt transformer output line 109 of the transformer 110. Arm 101 is ganged to like relay arms 102, 103, 104, and 105 for the other indicator assemblies 31–35 and, in one position, serves to activate the indicating units 121–125 of box 70 and buzzer units as 91–95 of indicator box unit 70 and, in the other position (shown in FIG. 4) of that switch 101 serves to activate the buzzer units 141–145 and indicating units 161–165 of remote box 230.

Each of the switch arms as 101, when powered by connection through relay arm 81 to the power source 120 as above described connects by a conductor as 231.1 to a corresponding conductor 231.2 in cable 131 to a corresponding conductor 231.3 in remote indicator assembly 230 to a pilot light as 161 which is connected to a ground wire directly; and that pilot light 161 is in parallel with a buzzer 141 which is connected by a pushbutton snap switch 151 which may be firmly yet releasably locked in closed position or (snapped) into an open position.

The cable 231 is connected like cables 232, 233, 234, and 235 to the remote control box 230. Accordingly, when the contact points 181 and 182 of a probe assembly as 41 are electrically connected by contact with an electrically conducted fluid or short circuited by the test switch 51, the relay 71 serves to lock in the 12 volt circuit to activate the pilot light 121 and, (if the push button switch 111 is closed), the buzzer 91 when the switch 101 is in its left hand (left as shown in FIG. 4) position. When the switch 101 is in its right hand position as shown in FIG. 4, when the contact points at 181 and 182 of the assembly 41 are connected by water contact therebetween the pilot light 161 of the remote assembly 230 is actuated. Also, if desired by the operator the buzzer 141 is also activated whereby the operator is notified audibly as well as visually of the conditions sensed by such assembly 31 at the location of the contact points 181 and 182 of its probe assembly 41 at junction of longitudinal conduit 27 and vertical pipe 201 for such contact points 181 and 182. The buzzer 141 is connected to the high voltage line 109 through the switch 101 when the pushbutton switch 151 is snapped to its closed position (Switches 151–155 are shown in their open position in FIG. 4).

FIG. 4 shows all switches in their open position although switches 151–155 and 111–115, may, alternatively, be kept in their closed position, and switches 101–105 may be moved from their right hand position (as shown in FIG. 4) to their left hand position as desired by the operator. The test switches 51–55 are operatively connected as shown in FIG. 4 to the probe units 41–45 respectively and are used to test the continuity of the cables (as 61–65) therefor test purposes and to test the continuity of the circuits from the probes (as 41–45) therefor to the indicator lights therefor (as 121–125 respectively) and the buzzers therefor (as 91–95 respectively) when the switches 101–105 are in their left hand position; those same switches 51–55 are used to test the continuity of the circuits through the cable 131 and the operation of the switches 101–105 when the operator desires to test the operativeness of the unit as 161–165 and 141–145 in the remote indicator box assembly 230.

Each probe assembly as 41 is composed of a pair of parallel vertically extending electrical contact points 181 and 182 (shown pictorially in FIG. 9) held in downwardly extending electrically non conductive water repellant sleeves therefor 183 and 184 respectively; the sleeves are supported on an electrically non-conductive water repellent base 185. This support 185 for the probe points 181 and 182 is held at lower end of a rigid electrically nonconductive rigid and waterproof sleeve 186 made of rigid polyethelene plastic. The tube 186 is held at its top at a short cylindrical head 187. This head has several helical peripheral threads 188 and supports a electrical support contact box 189 at the top of which is located the push button switch 51.

Figures 3, 12:
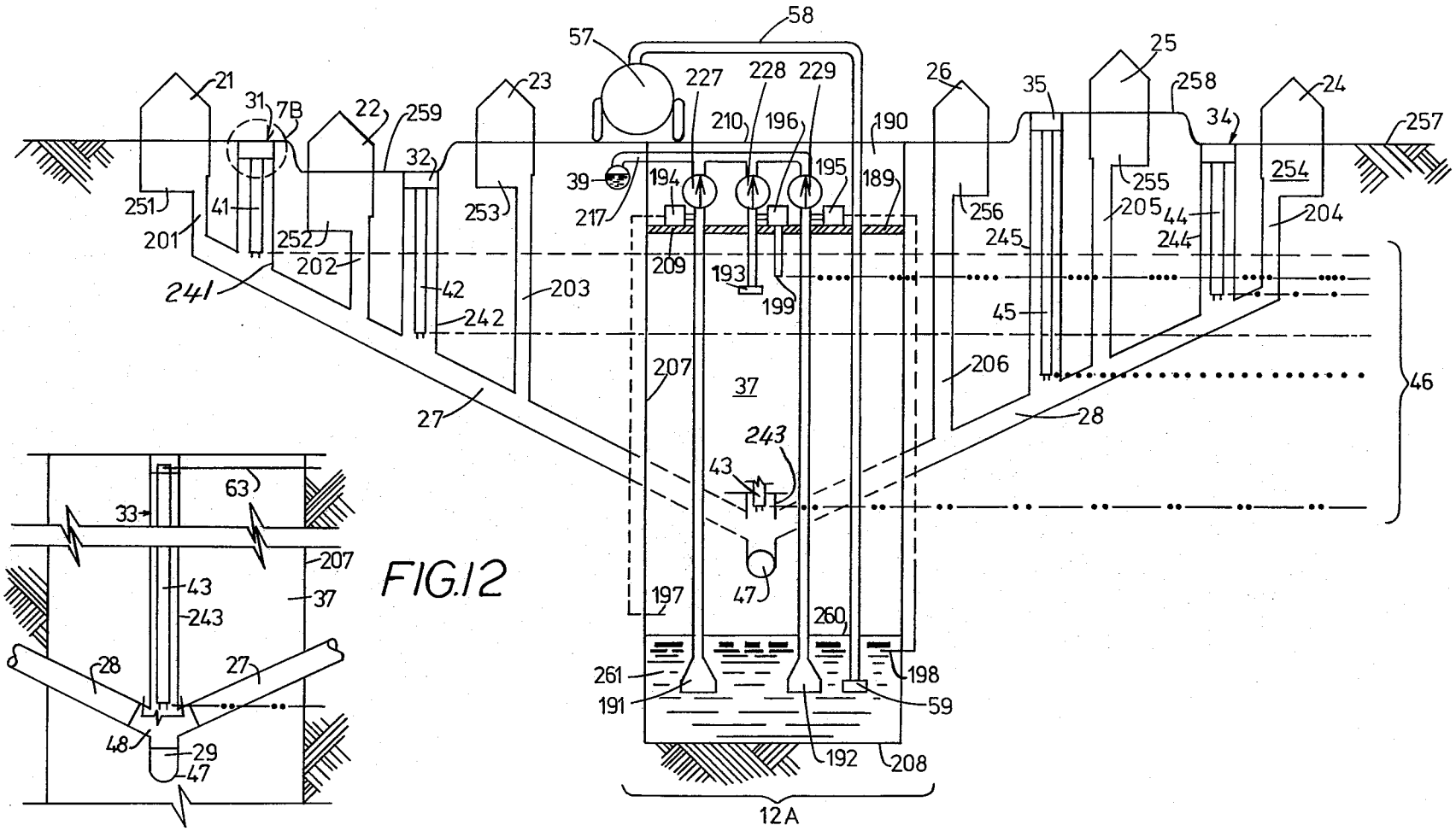
FIG. 3 is a diagrammatic elevation and developed view showing vertical relationships of the major components of the assembly 20 from one side thereof and with structures broken away to show the interior view of the sump chamber and tubes 241–245.
FIG. 12 is a diagrammatic view to the same scale as FIG. 3 taken at Zone 12A of FIG. 3 but showing an exterior view from the opposite side of sump chamber shown in FIG. 3 to show meeting of conduit 27 and 28 exterior to chamber 37 and above level of outlet 47 of conduit 29.
Figure 5:
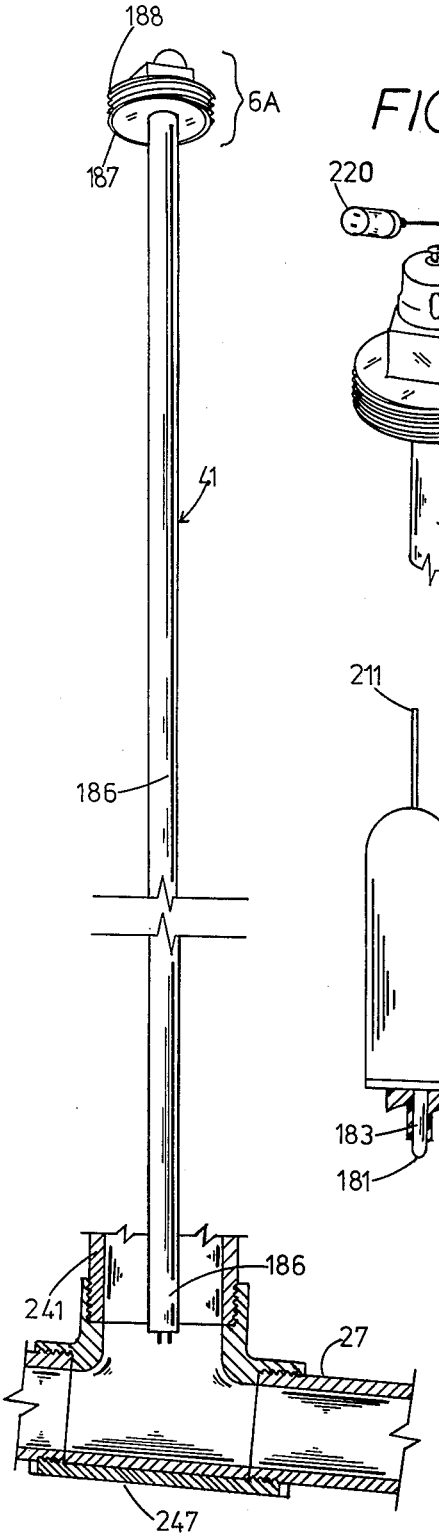
FIG. 5 is an overall perspective view of one of the probe units, 41, and structures adjacent thereto at its bottom end.
Figure 6:
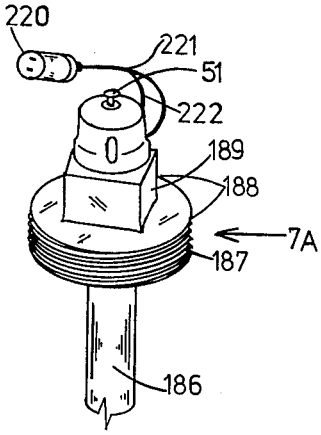
FIG. 6 is a top oblique perspective view of Zone 6A of FIG. 5.
Figure 7:
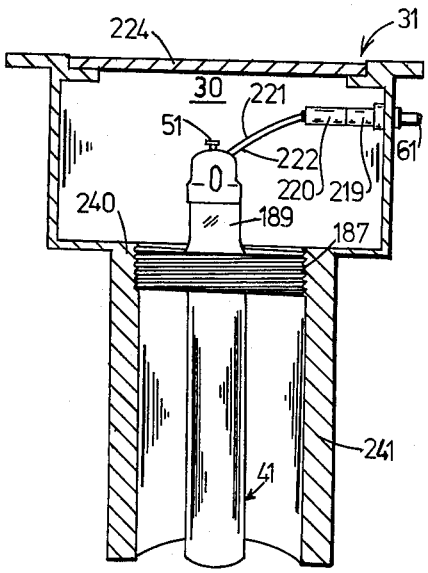
FIG. 7 is a side view of the upper end of probe unit 41 as seen along the direction of the arrow 7A of FIG. 6 and is an enlarged view of Zone 7B of FIG. 3.

Each rigid tube as 186 in conjunction with its threaded shoulder 187 provides a definite and firm positioning of its probe points as 181 and 182 from 3 to 4 inches above the intersection of the vertical tube (as 241) in which such tube is located and the sloped horizontally extending conduit, as 27, intersected by such vertical tube so that such points (181 and 182) are located above the adjacent portion of pipe 27 as shown in FIGS. 3 and 5.

In this position of the bottom end of each tube as 186, water in the conduit as 27 or other liquid while moving along the length thereof, as from left to right in FIG. 3 does not bend the tubes as 186 but the movement of the water when in a conduit as 27, simply slowly moves upward against the base 185 and does not provide any continual directional force transverse to the length of tube 186; also, the relative location of the points 181 and 182 to the shoulders or lateral extensions of the base plate 185, protects those points from direct contact with the electrically conductive wall 241.

Figure 8:
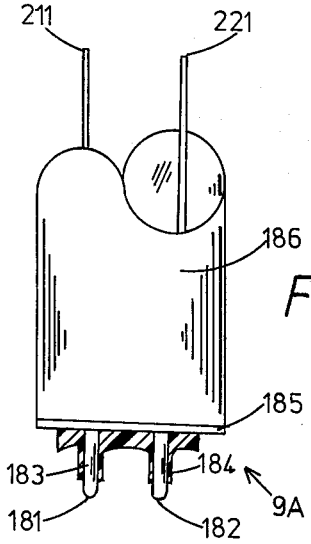
FIG. 8 is an enlarged side view of the bottom end of probe unit 41, with a portion in vertical diametral section.
Figure 9:
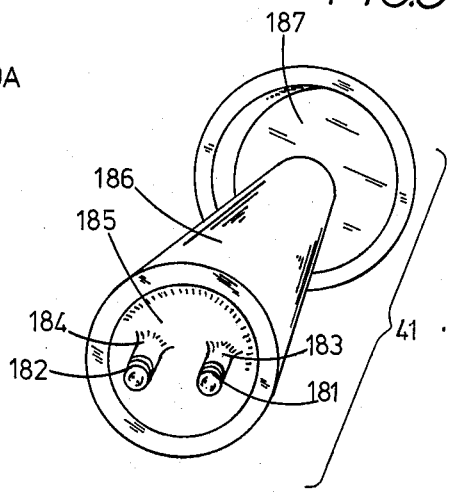
FIG. 9 is a pictorial view along the direction of the arrow 9A of FIG. 8.

Inasmuch as for each probe unit 41 (and 42–45) the width of each shoulder 187 is greater than the width of each tube as 186 each entire probe unit as 41 is readily taken out of the vertical pipe 241 for purposes of cleaning thereof. In normal course of events, the upper portion of tube 186 is simply not made wet except by such condensation that occurs by the evaporation of the water in the conduit and the sleeves 183 and 184 are so arranged (as shown in FIGS. 8 and 9) that such condensation does not provide a short circuit across the points 181 and 182 and, in usual operations, the electrical resistance is so high as, in combination with the low voltage applied through the long thin wires (211 and 221) of line 61 between the relay 71 and the transformer 110 and the contact points 181 and 182 that no action on the relay coil 71 results from condensation. However, on a development of a sufficient conductivity between points 181 and 182, as by a full immersion in a conductive liquid such as soapy water, each relay as 71 of assembly 20 is actuated by the 6 volt voltage applied to that relay and the contact points 181 and 182 at the low voltage terminal of the output coil of the step-down transformer 110.

Figure 2:
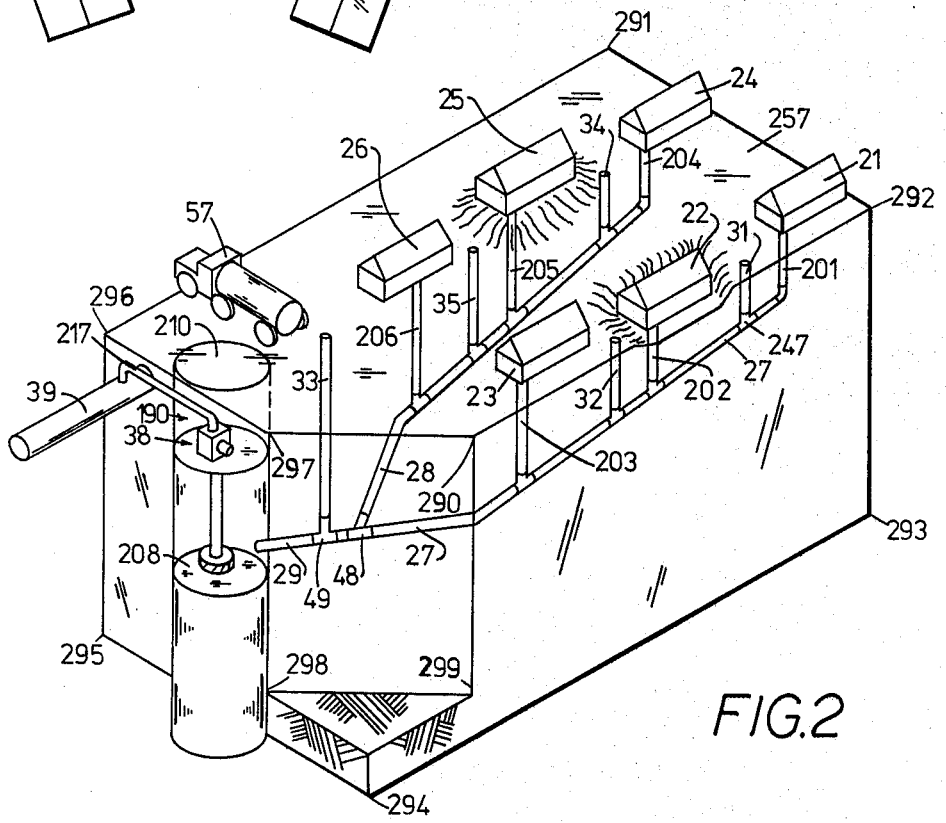
FIG. 2 is a diagrammatic isometric view of major components of the system 20 to show three dimensional characteristics thereof.

The general array of the system 20 as shown in FIG. 2 and 3 provides that the vertical conduits 201, 202, 203, 204, 205, and 206 from each of the houses 21–26 respectively passes vertically downward to meet and join the horizontally extending conduits 27 and 28 with the passages of the horizontally extending conduits (27 and 28) and the passages of the vertical conduits (as 201) opening to each other and the walls of the conduits firmly joined to each other with water and gas-tight fit. Each of the probe assemblies as 41–45 extends downward from wells therefor as 30 in which the top end of each of such assemblies as 41 is located and the probe points as 181 and 182 on each tube (as 186) of each such assembly (as 41) in each of the overall assemblies as 31–36 extends downward towards, but not into, the horizontally extending tube as 27–28. Accordingly, each probe point supporting tube is a concentric pipe or tube 241 is shown in FIG. 5.

As diagrammatically shown in FIG. 3, the overall arrangement of the level of such points for each of the probe assemblies 41–45 is indicated by the array (bracketed as 46) of differently composed lines indicating different vertical levels; i.e.—a series of dashed lines for vertical height or level of points 181 and 182 at bottom of probe 41; dash and dot line for vertical height or level of probe points at bottom of probe assembly 44, such probe points below level of probe points of unit 41; long dash and short dash for level of probe points at bottom of probe 42 (below level of points of unit 44); a series of dots for vertical level of probe points at bottom of probe unit 45 (below level of points at bottom of probe unit 42); and a series of dash and two dots for level of points as 181 and 182 at bottom of probe unit 43 (below level of points of probe unit 45). The relative levels of probes 197, 198, and 199 in the sump tank and the inlet opening 47 of conduit 29 are thus diagrammatically and qualitatively shown in FIG. 3 wherein the probe points (as 181 and 182) on the tubes (as 186) in each of the assemblies as 41–45 are located at one of the heights indicated in bracket 46 of FIG. 3 as above described.

The lines 27 and 28 join a wye connector 48 adjacent to tee 49 into the top of which tee 49 (as for tee 247) a tube 243 (like 241) extends and close to the depth of which tee probe unit 43 (like 41) extends; a line 29 extends from the tee 49 to an opening 47 into the sump chamber 37.

The conduit 29 enters into the sump 37 at its discharge opening 47, (which conduit discharge opening is also the inlet to the sump 37), at a height or level below the top of the sump (as shown in FIGS. 2 and 3) so that the upper surface or level as 260 of a body of liquid as 261 in sump 37 is measured not only by pump probes as 197 and 198 and 199 (which probes 197–199 actuate motors for the pumps 194 and 195 and 196) but also, the level of liquid as 260 in the sump 37 is also in the system 20 indicated by the level of liquid in the horizontally (and vertically) extending conduits 27 and 28 in cooperation with the actuation of each of the circuits as 31–35 when the level of liquid in the conduits 27 and/or 28 reaches a level of the probes (as 181 and 182) at the lower end of each of the probe units as 41–45. Such level of those probes on those probe units corresponds to the same height or level of liquid in sump 37. Additionally the lights 121–125 of the main indicator box 70 as well as the lights 161–165 in remote indicator box 230 serve to indicate the potential point of stoppage in conduit 27 or 28 and probes 41–45 provide readily cleansed sensor points that are more reliably responsive to the level of liquid in sump 37 than are probes as 197–199 located in the sump 37. Sensor probes in the sump 37 are difficult to reach as well as repeatedly made dirty and inoperative by the liquids which pass into sump 37. However, the probes points as 181 and 182 at the bottom of each of assemblies 41–45 are readily reached and cleaned by merely (a) opening the manhole cover as 224 on top of the chamber as 30 to expose the head as 187 and contact box as 189 of the probe unit as 41. (The threads 188 on the unit 41 engage female threads in a socket 240 at top of tube 241 to firmly yet releasably support the probe unit as 41. Like structures are provided for each of probe units 42–45); then disconnecting plugs 220 and 219, (b) unscrewing unit (as 41) from its socket (as 240) and (c) lifting the probe unit as assembly 41 out from its tube 241 and (d) cleaning the points thereof (as 181 and 182) with a rag.

Points for probes as 197–199 within the sump as 37 are readily and usually so cluttered by debris, such as rags in particular, which attach onto the points, as to create a false response that turns on pumps when the liquid level intended for pump motor actuation is not present and/or when screens are used around such points such rags and debris clog the screens to prevent access of liquid thereinto so that when liquid in the sump comes to the level of such screens, the sensor points within the sump are not sensitive thereto.

The pump assembly 38 comprises pumps 191, 192, and 193, their motors 194, 195 and 196 and control assemblies 197, 198 and 199 therefor including liquid level sensor probes.

The sump 37 is a chamber or hole below the ground level 257 and is vertically elongated and cylindrical in shape with a vertical central longitudinal cylindrical axis. The cylindrical wall 207 of sump chamber 37 extends from the bottom 208 of the sump chamber to the roof 210 of that sump chamber. A pump chamber floor 189 is located at the bottom of a pump chamber 190. The top wall 209 of the sump chamber 37 is the bottom wall of the motor chamber 190. The deep pumps 191 and 192, each with a motor therefor 194 and 195 respectively discharge into the sump discharge line 217 and from there into the sewer drain line 39. The pumps 191 and 192 have their inlet openings in the chamber 37 at a distance of three to four feet above the bottom 208 of such chamber 37; these are impeller pumps and discharge upward to the discharge line 217 through check valves 227 and 229 respectively. The motors 194, 195 and 196 are located in chamber 190 on and firmly supported on floor 189 and operatively connect to the pumps 191, 192 and 193 respectively. The motors for the pumps 191 and 192 are each operatively connected to probes 197 and 198; Probe 198 is located about 6 feet from the sump bottom 208 and probe 197 is located 8 feet above the bottom of the sump tank 37; thereby when the level of liquid in the sump is at the level of the probe 197 one of the pumps 191 operates; when the probe 198 is immersed both pumps 191 and 192 usually operate when pure liquids are involved.

The pump assembly 38 also includes a third, so called submersible pump 193. This pump has its inlet orifice at a level about 6 feet below the wall 209 and a sensor therefor, 199, is located at such level; accordingly, when that level of the liquid in the sump is reached then that pump is brought to operation; it operates through a check valve 228 and discharges into the line 217 and thereby into the sewer drain line 39.

In the system 20 the tubes as 186 provide a mechanical structures for support of points as 181 and 182 that is free of any upwardly directed surface; i.e., the elements providing support for points 181 and 182 on probes 41–45 have no surface that is perpendicular to a straight line which line would extend upward from such surface into a space that is below the minimum height of the sewer line 39 and, in the system 20, ever occupied by a liquid or liquid suspension or solid mixture, so that downward settling of solids on such points as 181 and 182 is obviated.

Also in the system 20, the points as 181 and 182 of each probe as 41 are located in a position, as shown in FIG. 5, above the normal level of liquid in the horizontally or longitudinally extending conduits 27 and 28 and there is a rather rapid flow of liquid in the conduits 27 and 28 so that any solid material which may contact the points as 181 and 182 is rapidly moved away by the rapid flow along the length of the conduits 27 and 28 into the sump 37.

In this type of system the probes as 197 and 198 are frequently blocked by debris which accumulates in the sump tank. However even under such circumstances, the visual and audible signals provided by lights and buzzers in the boxes 70 or 230 provide indications of level of the liquid in the tank 37. The locations of the liquid sensor elements in probes 41–45 are such that when indicator lights as 161–165 are on in box 230 there is about 45 minutes to 60 minutes capacity remaining in the sump 37 so that a pump and tank truck 57 may be called to insert a pump line 58 into the sump tank 37 whereby to empty the tank 37 notwithstanding that, under such conditions, there is burn out of the motors 194–196 or blockage of the pumps as 191–193; the lights of assemblies 230 and 70 also provide for indication of where blockage lies along the conduits 27 and 28.

The system 20 operates through a separate source of power than that which is used for the motors 194–196.

The problem of human error in the waste disposal systems is that not only normal human waste products, laundry liquids, food and waste material are sent into the lines 201–206, which does not cause blockage thereof, but, also, solid toys, cigarette packs, and cloth elements such as socks, stockings, wash rags and articles of like size of cloth accumulate on probe points as 197–199 and inhibit or prevent their action. The use of probe points as 181 and 182 spaced horizontally apart from the zone of settling of waste products of sump as 37 and above the line of normal flow of such waste products in line 27 and 28 and also spaced away from such volume as in system 20 provides that such blockage is not likely to occur on sensor points of probe units as 41–45. Also the location of the probes at different vertical levels as indicated diagrammatically in FIG. 3 and hereinabove described indicate liquid level in the sump tank prior to conditions which otherwise cause damage to the floors at levels below the level of the sewage line as 39.

In FIG. 2 the points 291, 292, 296, and 297 indicate the generally horizontal surface 257 in which the houses 21–26 are located. Each of houses 21–26 is about 40 feet wide and about 100 feet long and three stories high above ground and has a below ground story (as 251–256). As shown in FIGS. 2 & 3 some dwellings may be on lower levels of ground, as 259, and others at higher levels, as 258.

The vertical plane shown by points 292, 293, 294, 299, and 290 is parallel to and intersects the horizontally extending and downwardly sloped conduit 27 and, also, the pipes 241 and 242 of assemblies 31 and 32 as well as drain conduits 201, 202 and 203 to illustrate the downwardly sloped direction of the conduit 27 from house 21 to intersection of conduits 27 and 203. The vertical oblique plane outlined by points 290, 297, 298 and 299 is parallel to and intersects the axis of cylindrical line 27, (one arm of) wye 48, (arm of) tee 49 and line 29 to show the downwardly as well as horizontal direction of such axis from intersection of lines 203 and 27 to intersection of line 29 and sump 37.

The vertical plane outlined by points 294, 295, 296, 297 and 298 (with a semicylindrical protrusion under the bottom or floor 208 of the sump tank 37) represents a vertical plane perpendicular to the plane outlined by points 290, 292, 293 and 194 and to the plane outlined by points 290, 291, 292, 296 and 297, and is drawn to illustrate diagrammatically the relations of the interior of the sump tank 37 to the discharge line 217 therefrom to the sewer line and the other structures shown in FIG. 2. For purposes of illustration of the conduits 28, 204, 205 and 206, the surfaces of FIG. 2 above referred to are shown as transparent.

The indicating box 70 is located in the office 50 in the daytime for warning of the location manager and may be switched by switches 101–105 to the similar warning apparatus 230 to operate in his residence as in building 21 at night. Accordingly, a plumber or other equipped party may then be called to timely bring a pump wagon 57 as shown in FIG. 3 and empty the sump 37 by a conventional pump line 58 and pump 59, when the liquid level in sump 37 rises and indicators of warning system 20 light up and/or provide audible signals and prior to damage to the premises by such rising water level.

In the preferred embodiment points 181 and 182, as shown in FIGS. 8 and 9, are cylindrical and parallel to each other and rounded at their ends and the distance between the central longitudinal axis of such points or probes is 7/16 inch (11 mm); the probes expose bare metal for a length, as shown in FIG. 8, of $\frac{1}{8}$ inch and are $\frac{1}{8}$ inch (0.35 cm) in diameter; the sleeves 183 and 184 are 5/16 inch long from the surface of the base 185; the sleeves are 0.16 inch thick and formed of waterproof electrically non-conductive plastic 0.015 inch thick. Base 185 is $\frac{7}{8}$ inch in diameter and concave downwards. The tube 186 is made of schedule 40 PVC 1120/1220 pipe (ASTM D1785 CS 207 480 p.s.i.) and is 1 inch in diameter and lengths range from 6 to 20 feet. The base 187 is $3\frac{3}{8}$ inches in diameter and has threads $\frac{1}{8}$ inch wide; conductors 211–215 and 221–225 are each 7 strands of 0.01 inch diameter copper wire. The lengths of conduits 201–206 range from 5 to 20 feet. Conduits 241–245 like 27, are each rigid pipe of five inch internal diameter, usually cast iron. Base 185 has a peripheral downwardly directed lip at its lateral edge.

The distance from the furthest probe 41 to the proble adjacent the sump tank is about 200 feet. While one drain conduit as 201, is shown for each dwelling, as 21, more than one conduit may be used for each such dwelling. The depth of the sewer line 39 is 3 to 4 feet below the ground level 257 over which most of the dwellings are located; the lower levels 251–255 are 8 feet below such level of pipe 39. In the particular embodiment of system 20 shown, sump 37 diameter is 6 feet and depth is 20 feet and inlet 47 is between levels of probes 198 and 199 as shown in FIG. 3. Tubes as 186 are made of polyvinyl chloride.

Figure 10:
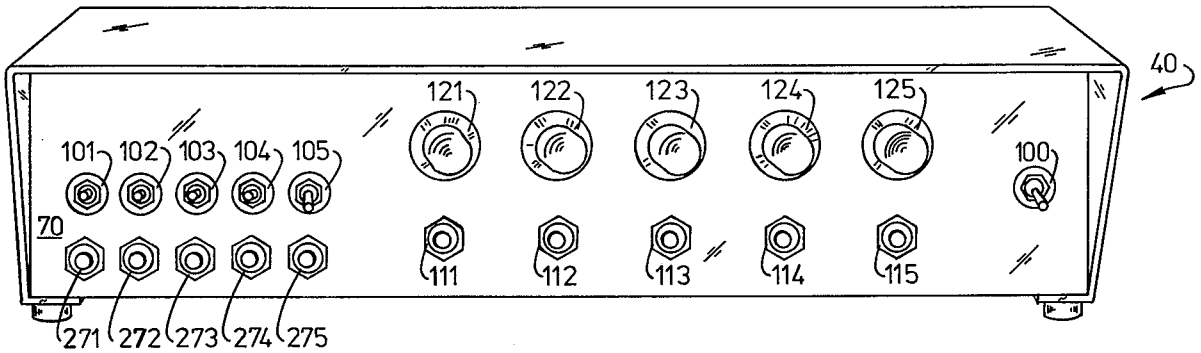
FIG. 10 is a front view of indicator assembly 40 along the direction of the arrow 10A of FIG. 11.
Figure 11:
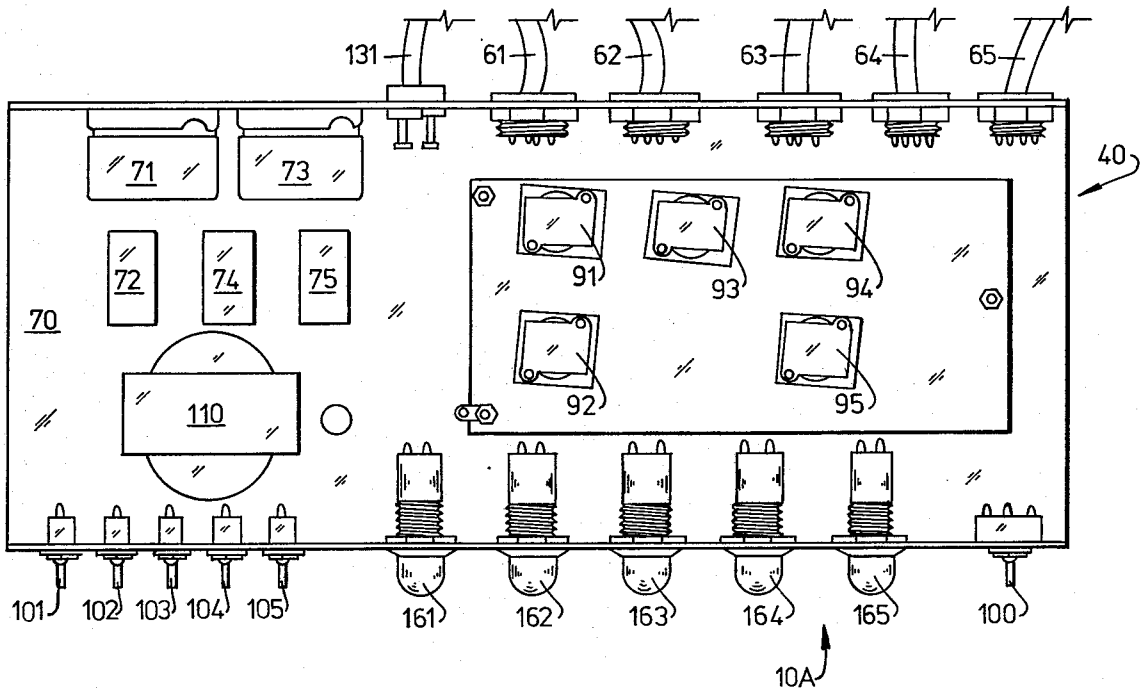
FIG. 11 is a top plan view of the main indicator assembly 40 with the top cover removed.

The main indicator assembly 40 comprises the casing 70 therefor and the components therein shown in FIGS. 4 and 11. Indicator assembly 40 is shown in FIG. 11 with electrical connector wires removed for purpose of clarity in representing the location and relative size of the principal structures thereof in a particular embodiment of the invention inasmuch as the electrical wire connections within the box 70 are shown in the wiring diagram of FIG. 4. The internal physical structure of remote indicator assembly 230 is substantially the same as that shown for assembly 40 except for the absence of the transformer 110 and relays 71–75. The dimensions of box 70 are 6 to 12 inches wide and 5 to 7 inches deep and $2\frac{1}{2}$ to 3 inches high depending on number of probes used and accordingly readily placed on top of a desk or night table or other convenient location for providing signals of emergency or potential flood conditions. FIG 10 is pictorial. The cables 61–65 and 131 are conveniently and readily located in the ground in stable plastic or other cables that extend from the location of each of the wells (as 30 for assembly 31) to the location of the main indicator assembly 40 or to remote assembly 230.

Installation of the system 20 with three probe stations as 31, 33 and 34 in an array of houses as 21–26 above described reduced flooding and damage costs, which, prior to the installation of the system 20, were in excess of $10,000.00 over a two-year period as payment outlays for damages, as well as (but not included in such figure) the labor cost for clean-up after such floodings; such flooding occurred fairly regularly, approximately once a week, over a period of a year; after the installation of the system there were no floods, which provided a substantial improvement in customer satisfaction as well as savings in expense otherwise incurred e.g. carpet cleaning required after such flooding.

Each of the probe points as 181 and 182 for each of probes 41–45 is in series with a rectifier so that the current through the water between such points as 181 and 182 is a unidirectional electrical current and, accordingly, utilizes the capacitance between the wires, as 211 and 221 for cable 61 (and wires 212–215 and 222–225 in each of cables 62–65) to improve the reliability and sensitivity of the relay as 71 (and 72–75) to the closure of electrical circuit by the presence of liquid between the probe points (as 181 and 182). The cables as 61 are generally 50 to 200 feet long, and accordingly have substantial electrical capacities. It is within the scope of this invention that, where a plurality of probes as 41–45 are used on any one collector line, as 27 or 28, that a lowest probe may also be within the tank rather than exterior of the tank as shown in FIGS. 2 and 3; i.e. the invention does not exclude having a probe in the sump tank 37. Normally open switches 271–275 provide for separately testing each of the circuits of assembly 31–35 respectively for continuity in and to box 230 and in and to box 70. Assembly 31 includes the above discussed components 51, 41, 61, 71, 81, 91, 101, 111, 121, 131, 141, 151, 161, 211, 221, and 241; assemblies 32–35 include similar components (as 61–65) indicated by reference numeral having the last digits 2 through 5 respectively (as 62–65) and having the same numbers in the hundreds unit and tens unit positions.

I claim:

1. A system of residences and sewerage systems therefor comprising:

a. A plurality of residences supported on a body of ground;

b. A ground level for each of such residences;

c. A vertically extending drain pipe for liquid wastes for each of said residences, with one, upper, end of said vertically extending drain pipe operatively connected to one of said residences;

d. A vertically extending sump tank at a location spaced away from at least one of said residences;

e. A pump assembly, and an inlet to said pump assembly located in said sump tank;

f. A horizontally extending drain collector pipe;

g. A plurality of vertically extending conduits each extending substantially to said ground level and operatively connected to said horizontally extending drain collector pipe and spaced away horizontally from said sump tank;

h. A horizontally extending sewer line;

i. A sensor and indicating assembly, and wherein;

j. Each of said residences comprises a living area at a vertical height below the level of said ground level and below the height of said horizontally extending said sewer line;

k. Each of said vertically extending drain pipes being horizontally spaced apart from other vertically extending drain pipes and extending downwardly to and operative connecting to said horizontally extending drain collector pipe;

l. All portions of said horizontally extending drain collector pipe slope downwardly toward said sump tank and are operatively connected to said sump tank;

m. Each of said vertically extending conduits has a lower end opening to and connecting to said horizontally extending drain collecting pipe at an intersection therebetween, said system including a plurality of such intersections, said vertically extending conduits being operatively connected to said sump tank through said horizontally extending drain collector pipe;

n. Said pump assembly has an outlet operatively connected to said sewer line, a power source operatively connected to said pump assembly; and, o. Said sensor and indicating assembly comprises, in operative combination, (i) a plurality of liquid level sensing means;

(ii) a vertically extending dimensionally stable sensor support means for each of said liquid level sensing means located in one of said vertically extending conduits, each of said liquid level sensing means attached to the bottom of one of said sensor support means and extending downward therefrom;

(iii) a plurality of sensor support positioning means each firmly supported in the ground and an attaching means on each of said sensor support means near its upper end attached to one of said sensor support positioning means and a source of electrical voltage;

(iv) each of said liquid level sensing means firmly located above an intersection of a vertically extending conduit and said downwardly sloped horizontally extending drain collector pipe and in said vertically extending conduit, each of said liquid level sensing means comprising a horizontally and narrowly spaced apart pair of vertically extending electrical conductors having different electrical polarity and the same distance between members of pairs of said vertically extending electrical conductors on all of said liquid level sensing means;

(v) said liquid level sensing means being located at different vertical levels and each of said liquid level sensing means being horizontally spaced away from said sump tank and below the height of the top of said sump tank;

(vi) a plurality of indicating means in a support therefor and an electrical conductor between each of said liquid level sensing means and one of said plurality of indicating means, each of said indicating means being indicative of liquid level at said one of said liquid level sensing means;

(vii) a plurality of electrical circuits each comprising a relay coil and one of said sensor assemblies in series across a low voltage source and a normally open relay switch electromagnetically actuated by said relay coil, with the same voltage applied across each of the pairs of conductors forming said liquid level sensing means at the bottom of each of said sensor support positioning means, said normally open relay switch being in series with a second, higher, voltage source and one of said indicating means;

(viii) said low voltage source actuating each said relay and each said indicating means being connected to a power source which is separate from the power source connected to said pump assembly; and, (ix) said support for said indicator means being remote from said sump tank and from one of said residences.

2. A system as in claim 1 where in said liquid level sensing means is free of upwardly directed surfaces and said sensing means is indicative of level of electrically conductive liquid.

3. A system as in claim 2 wherein said horizontally extending drain collector pipe includes a plurality of such intersections between said drain collector pipes and said vertically extending conduits.

4. A system as in claim 2 including a plurality of such horizontally extending drain collector pipes.

5. System as in claim 4 including also, for each relay in said circuit, a second indicating means remote from said first indicating means and in electrical series with said second voltage source and said switch.

6. Process of monitoring a system of a plurality of residential structures and sewerage system therefor wherein liquid waste from each of said structures flows vertically through a vertical drain line, thence to a horizontally extending drain collector line and thence to a sump tank and is normally elevated from said sump tank by a pump assembly to a sewer drain line above the level of said residence floor and the improvement which comprises the steps of:

A. Sensing liquid levels at different vertical levels in each of a plurality of horizontally and vertically spaced apart points outside of said sump tank;

B. Providing indication of the results of all of said plurality of sensing steps at a point remote from said sump tank; and, C. Adding additional pumping capacity to empty said sump in response to indication of elevated liquid level from said points outside of said sump.

7. Process as in claim 6 comprising the added steps of applying unidirectional low voltage to each of said points for liquid level sensing through a first circuit therefor and actuating one of said first circuits in response to presence of conductive liquid at one of said points of liquid level sensing and applying a high voltage alternatively to one of a plurality of signalling means at a first location and to a corresponding one of a corresponding plurality of signalling means at a second location spaced apart from said first location whereby the system is under constant surveillance.

* * * * *